United States Patent [19]

Minasy et al.

[11] Patent Number: 4,987,754

[45] Date of Patent: Jan. 29, 1991

[54] MAGNETICALLY RELEASABLE TARGET LOCK

[75] Inventors: Arthur J. Minasy, Woodbury; Christopher Olszewski, Roslyn Heights, both of N.Y.

[73] Assignee: Knogo Corporation, Hauppauge, N.Y.

[21] Appl. No.: 465,048

[22] Filed: Jan. 12, 1990

[51] Int. Cl.[5] ..... E05B 65/00

[52] U.S. Cl. ..... 70/57.1; 70/276

[58] Field of Search ..... 70/34, 57.1, 276

[56] References Cited

U.S. PATENT DOCUMENTS

| | | | |
|---|---|---|---|
| 3,911,534 | 10/1975 | Martens | 24/150 |
| 3,973,418 | 8/1976 | Close | 70/34 |
| 3,995,900 | 12/1976 | Humble et al. | 70/57.1 |
| 4,502,717 | 3/1985 | Close | 70/57.1 |
| 4,590,461 | 5/1986 | Cooper | 340/572 |
| 4,603,453 | 8/1986 | Yokoyama | 70/57.1 |
| 4,651,136 | 3/1987 | Anderson et al. | 340/572 |
| 4,670,950 | 6/1987 | Wisecup et al. | 70/57.1 |
| 4,722,119 | 2/1988 | Green | 24/155 |
| 4,774,503 | 9/1988 | Bussard | 70/57.1 X |

FOREIGN PATENT DOCUMENTS

| | | | |
|---|---|---|---|
| 0021849 | 1/1981 | European Pat. Off. | 70/57.1 |

*Primary Examiner*—Gary L. Smith
*Assistant Examiner*—Suzanne L. Dino
*Attorney, Agent, or Firm*—Fitzpatrick, Cella, Harper & Scinto

[57] ABSTRACT

A magnetically releasable pin lock which comprises catch elements mounted to pivot about axes perpendicular to and displaced from the pin axis and elongated magnetizable actuation elements which extend from the catch elements along the pin axis to be acted upon by applied magnetic decoupling fields and to move in response to such fields to pivot the catch elements and release the pin.

18 Claims, 4 Drawing Sheets

MAGNETICALLY RELEASABLE TARGET LOCK

BACKGROUND OF THE INVENTION

1. Field of the Invention This invention relates to lock mechanisms for holding target wafers to articles of merchandise and more particularly it concerns a novel lock construction which can be manufactured easily and economically and which provides strong and reliable locking with positive release.

2. Description on the Prior Art

U.S. Pat. No. 4,590,461 shows a lock mechanism for holding a target wafer to an article of merchandise. The target wafer is a thin flat plastic housing in which an electrical circuit is embedded. The electrical circuit is designed to produce a characteristic disturbance to an electromagnetic interrogation signal when the article of merchandise is carried past a doorway or other exit path where the interrogation signal is generated. This disturbance is detected by a monitor at the doorway and the monitor in turn actuates an audio or visual alarm. The lock mechanism is releasable by means of a special magnetic tool under the control of a sales clerk or other authorized person; and upon release of the lock mechanism, the target wafer is removed from the merchandise so that the merchandise can be carried out through the doorway without actuating the alarm. The lock mechanism shown in U.S. Pat. No. 4,590,461 is known as a "ball clutch" type lock mechanism. This mechanism comprises a cone and an internally tapered ring arranged within the wafer housing and a spring which presses the cone into the tapered ring. The cone has an axial hole to accommodate the shank of a pin fastener and a pair of transverse holes which intersect the axial hole and which accommodate locking balls. When a fastener pin is projected into the axial hole it passes between the balls. The cone holds the balls in position between the pin shank and the tapered wall of the ring. Any axial force on the pin in the direction of pin removal causes the balls to become more tightly squeezed between the pin and the ring wall. The lock is released by application of a magnetic force to the cone to pull it against the force of the spring in a direction opposite the direction of pin removal. This cone movement brings the balls to a position along the ring wall where they are no longer wedged between the pin and wall; and the pin may then be easily removed.

The above described lock mechanism is very strong and secure and it operates very reliably to release the pin when a magnetic force is applied to the cone. The mechanism however is somewhat expensive to manufacture in that the cone and ring must be individually machined and a separate spring and balls must also be provided.

U.S. Pat. No. 4,722,119 describes another lock mechanism which comprises a one piece sheet metal element which is slit to form flange-like jaws that bend up and away from each other when the shank of a pin type fastener is pushed between them. Any axial force on the fastener in the direction of removal forces the flange jaws more tightly against the pin shank. However, when a magnetic force is applied to risers extending from the flange jaws, this force, according to the patent, pulls the jaws in a direction away from pin removal and forces them apart from each other and from the pin shank so that the pin may be removed.

The above described lock mechanism of U.S. Pat. No. 4,722,119 is of one piece construction; however, since the flanges which lock the pin must be flexed to release the pin, the device is either too rigid to permit reliable release or it is too flexible to provide secure locking.

SUMMARY OF THE INVENTION

The present invention overcomes the above described problems of the prior art. According to the present invention there is provided a novel target wafer lock mechanism which is economical to produce and which is strong and durable while permitting positive and reliable release when a magnetic field is applied to the mechanism.

In one aspect, the present invention comprises a housing formed with an internal cavity and a pin access hole extending along a longitudinal axis into the cavity from outside the housing. A rigid catch element is mounted within the cavity for limited pivotal movement about a pivot axis perpendicular to and displaced from the longitudinal axis. The catch element includes a front edge which moves toward and away from the longitudinal axis as the catch element pivots about the pivot axis. An elongated magnetizable actuation element is arranged within the cavity to extend from a location on the catch element displaced toward the longitudinal axis from the pivot axis. The actuation element extends generally along the longitudinal axis in a direction away from the access hole.

DETAILED DESCRIPTION OF THE PREFERRED EMBODIMENT

Figure 1:
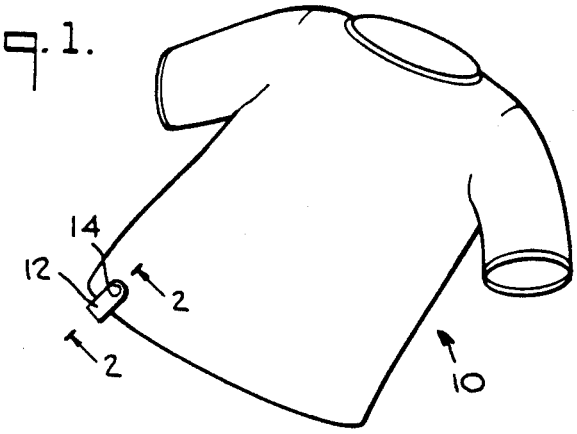
FIG. 1 is a perspective view of an article of merchandise to which is attached a target wafer having a lock mechanism according to one embodiment of the invention.

As shown in FIG. 1, an article of merchandise to be protected from theft, such as a shirt 10, is provided with a target wafer 12 which is fastened to the shirt with a lock mechanism 14 according to the present invention. As is well known in the electronic article surveillance industry, the target wafer 12 contains an electronic element or circuit which is capable of causing a characteristic disturbance to an interrogating electromagnetic field being generated at a doorway or egress passageway from a protected area. If the shirt 10 with the wafer 12 attached is carried through the doorway or other egress passageway, the element or circuit in the wafer will cause the characteristic disturbance and a monitor at the doorway or passageway will detect this disturbance and actuate an alarm. When the shirt 10 is purchased, the clerk or other authorized person uses a special tool (not shown) to apply a strong magnetic field to the lock mechanism 14 which enables the wafer 12 to be removed from the shirt so that the shirt can be taken through the doorway or egress passageway without actuating the alarm.

Figure 2:
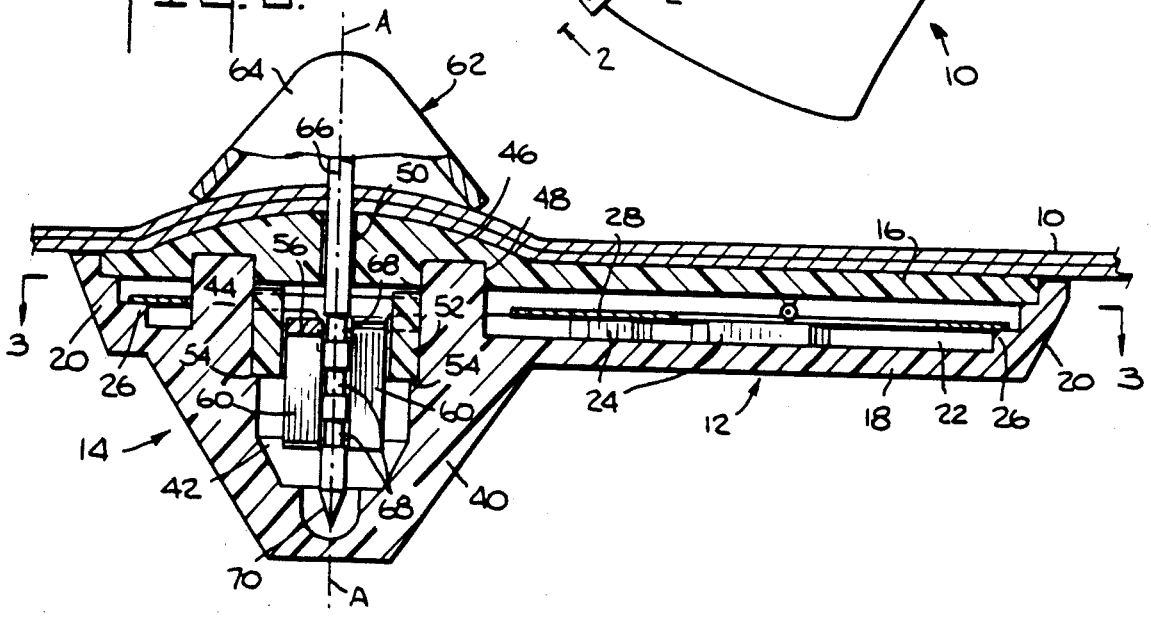
FIG. 2 is an enlarged fragmentary section view taken along line 2—2 of FIG. 1.
Figure 3:
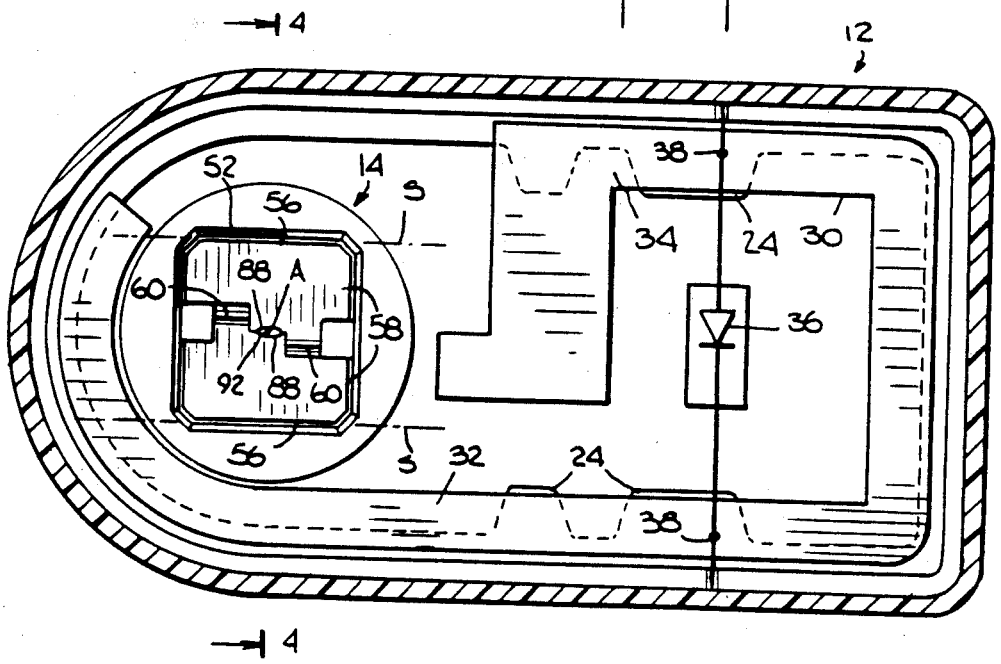
FIG. 3 is a plan view taken along line 3—3 of FIG. 2.

The construction of the wafer 12 and the lock mechanism are best seen in FIGS. 2 and 3. As shown in FIG. 2, the wafer 14 comprises a flat expansive cover 16 and base 18, both of which are molded from high impact polystyrene. The base 18 is formed with a peripheral wall 20 which defines a target circuit recess 22. The recess is also formed with abutments 24 and shoulders 26 which support a target circuit 28. The target circuit per se is not part of the invention and any type of target or target circuit may be used. However, for purposes of illustration, there is shown a target circuit suitable for producing characteristic disturbances to signals at microwave frequencies. This target circuit comprises an antenna 30 (FIG. 3) made of sheet copper in a generally U-shaped configuration with a first longer leg 32 and a second shorter leg 34. A diode 36 is connected across the legs 32 and 34 of the antenna 30 and is attached thereto at weld points 38. The longer antenna leg 32 extends beyond the weld point 38 to the opposite end of the target where it curves part way around the end of the target housing and then terminates. The shorter antenna leg 34 turns sharply inward just beyond the weld point 38 and extends toward the longer leg where it terminates just short of the longer leg.

The base 18 is formed near one end with a lock housing projection 40 (FIG. 2) of generally conical outer configuration which projects outwardly from the surface of the base. The lock housing projection is formed with a lock housing cavity 42 which opens out inside the peripheral wall 20 of the base 18. An abutment wall 44 extends up out of the base 18 around the cavity 42.

The cover 16 is formed with a dome shaped fastener support region 46 in alignment with the lock housing projection 40 on the base 18. A recess 48 is formed in the fastener support region to accommodate the upper end of the abutment wall 44 to form a solid enclosure for the lock mechanism to be described. A fastener pin access opening 50 extends through the center of the dome shaped fastener support region 46 in the cover 16 and into the lock housing cavity 42 of the base 18. The fastener pin access opening 50 extends along a longitudinal axis A which also forms the longitudinal axis of the lock housing cavity 42.

A lock mechanism is provided inside the lock housing cavity 42. This lock mechanism comprises a tubularly shaped spring unit 52 of rectangular cross-section, which fits closely within the cavity 42 and rests on a ledge 54 formed within the cavity, and a pair of catches 56 (FIG. 3) which are supported by the spring unit. The catches 56 each have a wing portion 58, which rests on the spring unit 52, and a leg portion 60 which extends down through the spring unit toward the bottom of the lock housing cavity 42.

A fastener pin 62 (FIG. 2), having an expansive head 64 and a cylindrical shank 66, pins the shirt 10 or other merchandise to be protected to the target wafer 12. The pin shank 66, which is formed with axially spaced peripheral recesses 68 and a tapered point 70, passes through the shirt 10 and then it extends through the access opening 50 and into the lock housing cavity 42 where it is gripped by the catches 56 of the lock mechanism. Any attempt to remove the pin 62 forcibly will only cause the catches 56 to grip the pin shank 66 more tightly. However when a strong axial magnetic force is applied to the catch legs 60, the catches 56 are tilted to release the pin shank 66 and the pin 62 is easily removed. The peripheral recesses 68 along the pin shank are not necessary to the invention but merely provide a better gripping surface for the catches 56.

Figure 9:
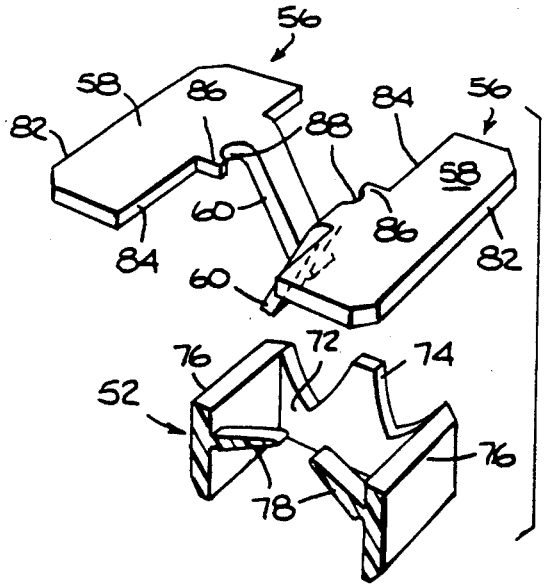
FIG. 9 is an exploded perspective view, partially in section of a spring and catch subassembly portion of the lock mechanism of FIG. 1.
Figure 8:
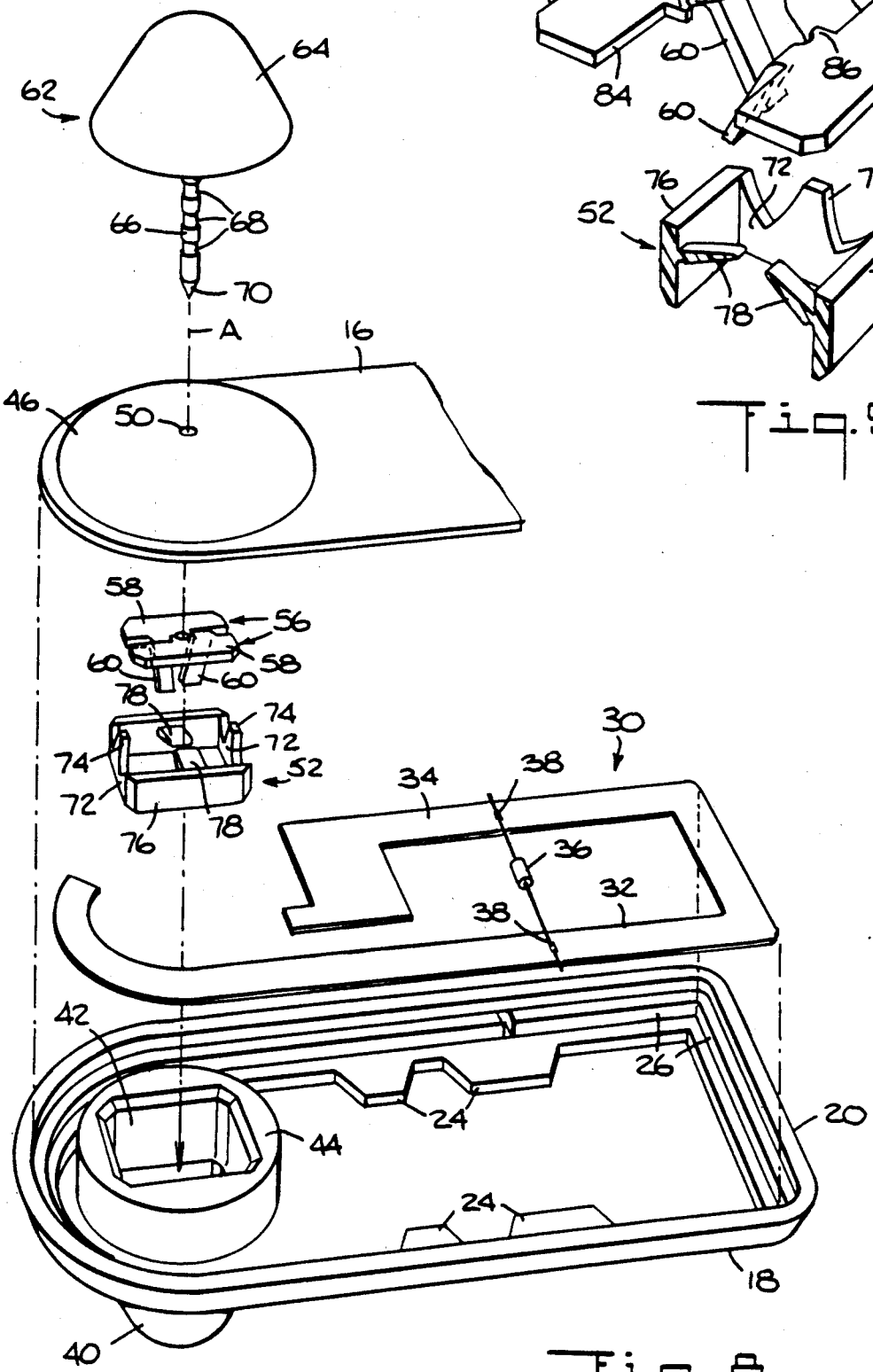
FIG. 8 is an exploded perspective view of the target wafer and lock mechanism of FIG. 1.

The construction of the spring unit 52 and the catches 56 is best seen in FIGS. 8 and 9. As there shown, the spring unit 52, which is molded in one piece from a strong yet flexible material such as Delrin 500, is of square cross-section tubular configuration. The spring unit 54 comprises a pair of end walls 72, each having a center post 74 extending upwardly from near the center of its upper edge, and a pair of side walls 76, each having a spring arm 78 extending in cantilever fashion inwardly and upwardly from a central location between its upper and lower edge. The outer cross-section of the spring unit 52 is dimensioned to fit closely within the lock housing cavity 42 formed in the lock housing projection 40 of the wafer base 18.

The size of the lock mechanism components is not critical to the invention; however, to illustrate the relative sizes of these components the following dimensions of the preferred embodiment are given. In this embodiment the end walls 72 are 0.372 inches long, 0.062 inches thick and slant downwardly from a height of 0.120 inches where they meet the side walls 76 to the center posts 74. The center posts 74 rise to a height of 0.172 inches from the lower edge of the end walls and have a width at their upper edge of about 0.050 inches. As shown, the center posts curve outwardly near the bottom thereof where they merge with the downwardly slanting end walls 72. The center posts 74 are mutually offset such that one of the posts is closer to one of the side walls 76 and the other center post is closer to the other side wall. The amount of the offset is about 0.025 inches. The side walls 76 are each 0.344 inches long, 0.120 inches high and 0.030 inches thick. The spring arms 78 are each 0.110 inches long, approximately 0.020 inches thick and 0.082 inches wide. The spring arms are molded integrally to the side walls and are each formed with a cylindrical recess having a radius of 0.010 inches along the underside thereof to provide a hinge of about 0.015 inches thickness where they join the side walls 76. The hinges provide a predetermined amount of resilience which is sufficient to support the catches 56 and yet permits the catches to bend the arms downwardly in response to an applied magnetic unlocking field. The spring arms 78 extend from locations on the inner surface of the side walls 76 midway along their length and about 0.040 inches from their upper edge. The spring arms slant upwardly as they extend from the side walls so that their outer ends are about 0.020 inches below the upper edges of the side walls 76.

The catches 56 are each formed from a ferromagnetic material of sufficient hardness to hold the shank 66 of the fastener pin 62 securely without appreciable wear. Preferably the catches 56 are formed of SAE 1010 cold rolled steel which is heat treated to form a carbon nitride casing and then nickel plated. In the illustrated embodiment, the catches 56 are 0.036 inches thick. The wing portions 58 are flat, generally rectangular sections about 0.344 inches long by 0.136 inches wide with a rear edge 82 and a front edge 84. A gripper projection 86 extends out from the center of the front edge 84 to a distance of about 0.188 inches from the rear edge 82. The front of the gripper projection 86 contains an elliptical recess 88 which forms a gripper surface to grip the shank 66 of the fastener pin 62. In the illustrated embodiment, the elliptical recess has a major axis, parallel to the front edge 84, of 0.048 inches and a minor axis, perpendicular to the front edge 84, of 0.036 inches. The major axis of the elliptical recess 88 lies along the front edge of the gripper projection 86 so that the recess 88 extends into the gripper projection by 0.036. The minor axis of the recess 88 is midway along the length of the catch wing portion 58. The catch leg portion 60 extends out from the front edge 84 of the wing portion 58 on one side of the elliptical recess 88 and is bent to extend downwardly therefrom at an angle of about 65 degrees from the plane of the wing portion 58.

In assembling the target wafer 12, as shown in FIG. 8, the antenna 30, with the diode 36 welded thereto (or other field disturbance element or circuit) is placed in the base 18. Also, the spring unit 52 is positioned in the lock housing recess 42 and the two catches 56 are positioned over the spring unit. As can be seen, the wing portion 58 of each catch rests, respectively, on an associated side wall 76 and spring arm 78 of the spring unit 52. Also, the leg portion 60 of each catch extends down through the spring unit and into the lock housing recess 42. Because the leg portions 60 of the catches are offset with respect to the gripper edge 88, when the catches are assembled facing each other, their respective leg portions extend down through the spring unit 52 and the lock housing recess 48 along opposite sides of their common longitudinal axis. When the spring unit 54 and catches 56 are in place, the cover 16 is positioned over the base 18 and is sealed to the base either with an adhesive or by some other well known technique such as ultrasonic welding.

Figure 4:
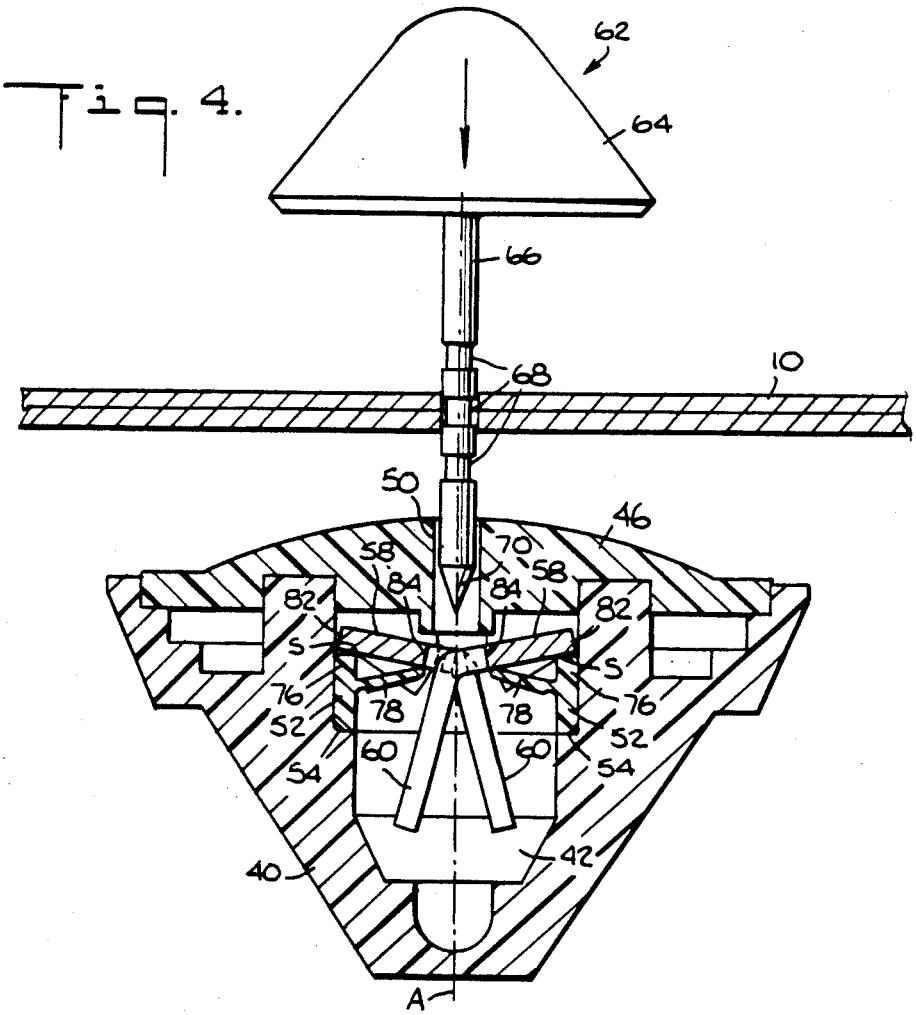
FIG. 4 is a section view taken along line 4—4 of FIG. 3 showing the insertion of a fastening pin into the lock mechanism.
Figure 5:
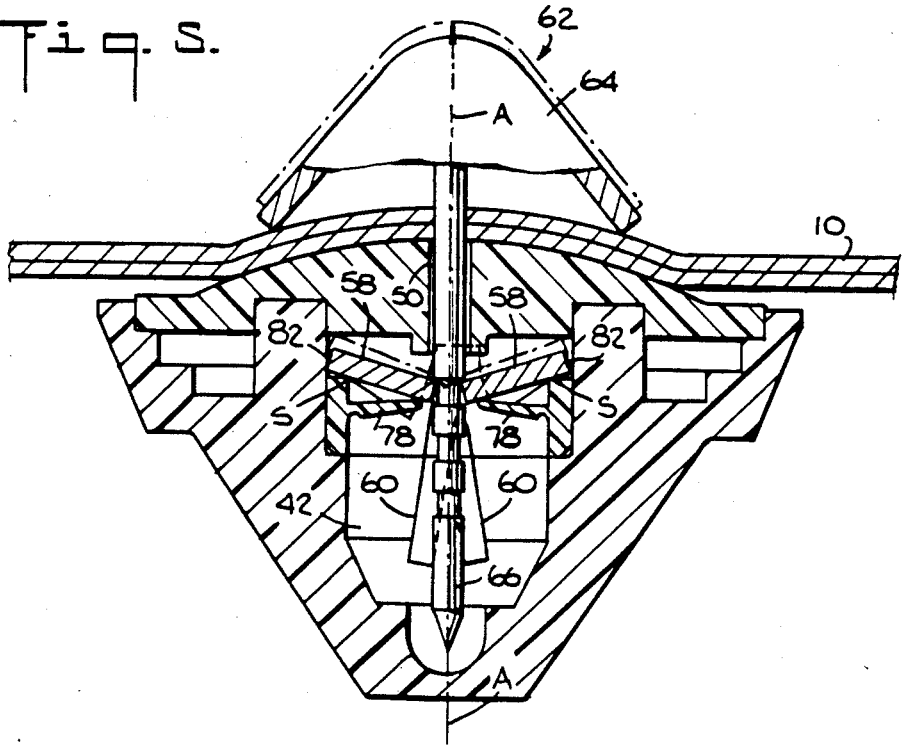
FIGS. 5, 6, and 7 are views similar to FIG. 4 but showing the locking mechanism with the fastening pin fully inserted, showing the lock mechanism released upon application of a magnetic field and showing the fastener pin being removed during application of a magnetic field.

FIGS. 4–7 illustrate the use of the above described lock mechanism. As shown in FIG. 4, the shank 66 of the fastener pin 62 is pushed through the shirt 10 (or other merchandise to be protected) and then through the fastener pin access opening 50 in the dome shaped fastener support region 46 of the wafer cover 16. The pin 62 is pushed into the opening 50 until the expansive head 64 of the pin presses the material of the shirt 10 down against the fastener support region 46 as shown in FIG. 5.

As shown in FIG. 4, before the pin 62 is pushed into the wafer 12, the catches 56 are loosely held in the lock housing recess 48 above the spring unit 52 and below the dome shaped fastener support region 46 of the cover 16. The rear edge 82 of each catch wing portion 58 rests on the upper edge of a different sidewall 76 of the spring unit near the lock housing abutment wall 44. The wing portions 58 of the catches 56 each extend from their respective spring unit sidewalls 76 toward the longitudinal axis A where their respective gripper projections 86 meet, as shown in FIG. 3. As can be seen in FIG. 3, the recesses 88 formed in the two catches 56 cooperate to form a small opening 92 along the axis A.

The spring arms 78 of the spring unit 52 support the catches 56 near the front edges 84 of their wing portions 58 to hold the wing portions in a position such that they slant downwardly away from the access opening as shown in FIG. 4. However, because of the flexibility of the spring arms, the wing portions 58 can pivot to slant further downwardly about swing axes S (FIG. 3) extending perpendicular to and displaced away from the longitudinal axis A, i.e. along the upper edges of the sidewalls 76, when a force is applied to the catches 56 in a direction along the longitudinal axis A and away from the access opening 50.

When the catches 56 are held in their normal position by the spring arms 78, the axes of their elliptical gripper recesses intersect the longitudinal axis A. Thus when the shank 66 of the fastener pin 62 is pushed through the access opening 50, the tapered point 70 of the pin passes through the opening 92 formed by these two recesses. The pin shank 66, however, is larger than the opening 92 (FIG. 3) and the force of the pin 62 overcomes the force of the spring arms 78 and causes the catch wings 58 to swing about their respective swing axes S. As a result, as shown in FIG. 5, the gripper projections 86 of the gripper wings 58 move away from each other and the size of the opening 92 becomes enlarged to accommodate the pin shank 66.

While the pin shank 66 moves downwardly between the catch wings 58, the spring arms 78 maintain the front edges of the wings pressing against the shank. After the pin shank is fully inserted, as shown in FIG. 5, any upward axial force on the pin tending to pull it out of the fastener will simply cause the catch wings 58 to pivot upwardly about their respective swing axes S so that their front edges press even more tightly against the pin.

The upward force transmitted from the pin shank 66 to the catch wings will also tend to force the wings 58 away from each other. However, this movement is limited by the inner wall of the recess 42 against which the rear edges 82 of the wings come into contact. Because the cross section of the recess 42 in this region is rectangular (to accommodate the rectangular cross section of the spring unit 52), the unit pressure of the metal wing portions 58 against the plastic inner wall of the recess 42 is minimized. Consequently any axial force tending to pull the pin shank 66 upwardly will be strongly resisted by the thick wall surrounding the recess 42.

Figure 6:
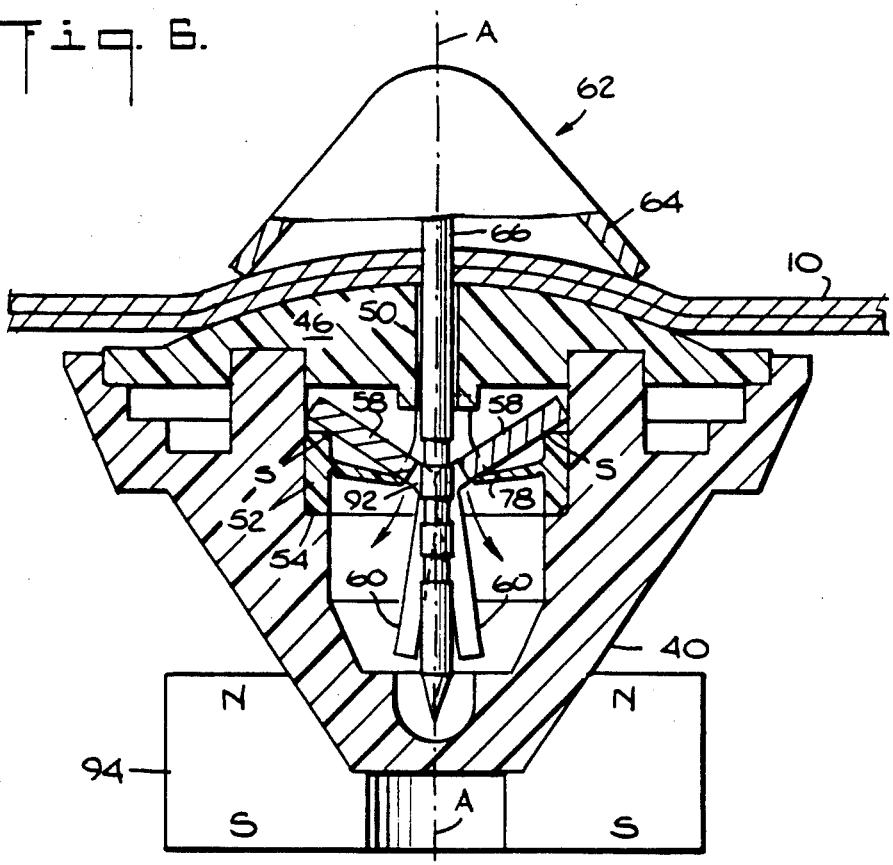
Figure 7:
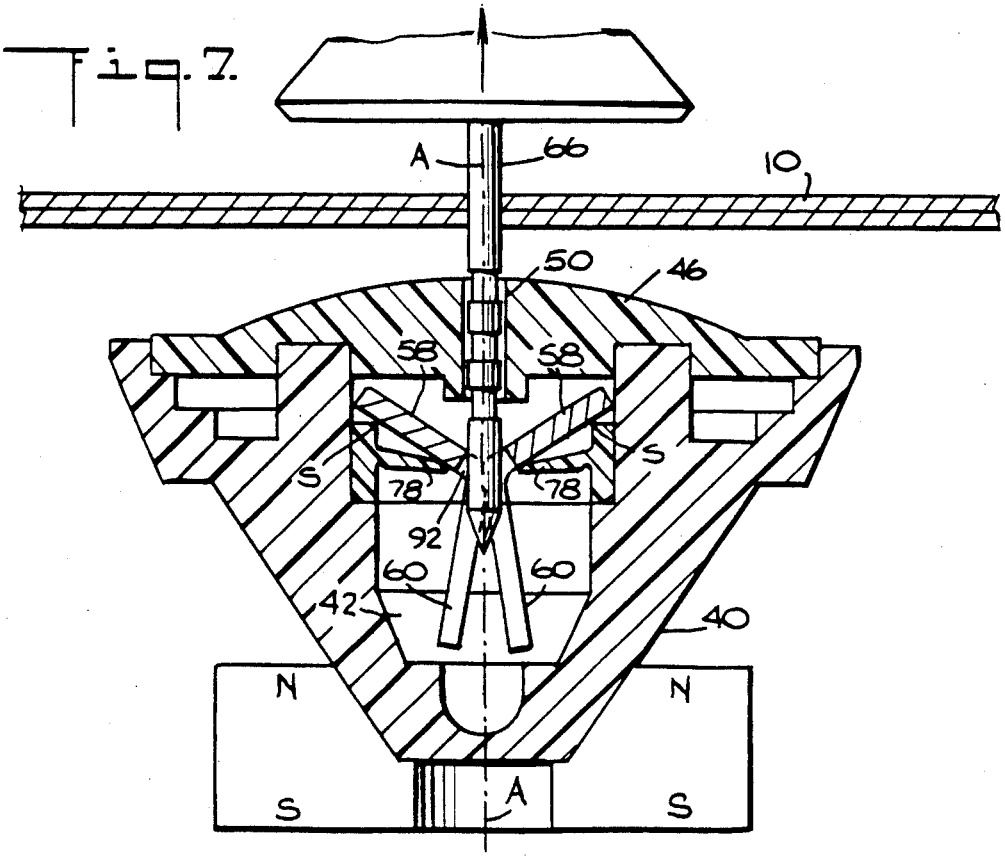

In order to release the pin 62 from the locking mechanism, an axial magnetic field is applied in the region of the lock housing projection 40 as shown in FIGS. 6 and 7. This magnetic field can be generated by any of several well known decoupling devices used with the well known ball clutch type fasteners. The magnetic field can be generated either by a permanent magnet or by an electromagnet as shown, for example, in U.S. Pat. No. 3,911,534. Such decoupler is represented schematically at 94 in FIGS. 6 and 7; and it applies a downward force along the axis A inside the lock housing 40. This magnetic force acts on the catch legs 60 and pulls them downwardly, thus causing the catches 56 to pivot about their respective swing axes S. The magnetic force is sufficient to overcome the upward pressure of the spring arms 78 on the underside of the catch wings 58 so that they swing down against the spring arms. This brings the front edges 84 of the catch wings away from each other and enlarges the opening 92 (FIG. 3) formed between the catches. The gripping force on the pin shank is thus released; and as long as the axial magnetic field remains applied, the pin can be withdrawn as shown in FIG. 7. It will be appreciated from the foregoing that the lock mechanism of the present invention is simple in structure, does not require high precision complex parts and assembly, and yet is reliable and durable in use.

What is claimed is:

1. A magnetically releasable pin lock comprising; a housing formed with an internal cavity and a pin access hole extending along a longitudinal axis into said cavity from outside said housing; a rigid catch element mounted within said cavity for limited pivotal movement about a pivot axis perpendicular to and displaced from said longitudinal axis, said catch element including a front edge which moves toward and away from said longitudinal axis as said catch element pivots about said pivot axis; and an elongated magnetizable actuation element within said cavity and extending from a location on said catch element displaced toward said longitudinal axis from said pivot axis, said actuation element extending generally along said longitudinal axis in a direction away from said access hole.

2. A magnetically releasable pin lock according to claim 1, wherein said magnetizable actuation element is a leg integrally formed on said catch element and extending from a location along said front edge.

3. A magnetically releasable pin lock according to claim 1, wherein said catch element is resiliently biased with its said front edge forced toward said longitudinal axis.

4. A magnetically releasable pin lock according to claim 1, wherein a further catch element, similar to the said catch element, is arranged symmetrically therewith in said housing to pivot about a second pivot axis and to cooperate with the said catch element to grip a pin shank extending along said longitudinal axis between the front edges of said catch elements.

5. A magnetically releasable pin lock according to claim 4, wherein each catch element is of generally flat rectangular configuration.

6. A magnetically releasable pin lock according to claim 4, wherein shoulders are formed in said cavity to extend along said pivot axes and to support each of said catch elements along a rear edge thereof.

7. A magnetically releasable pin lock according to claim 6, wherein a tubular insert is provided in said cavity and is shaped to form said shoulders.

8. A magnetically releasable pin lock according to claim 7, wherein said tubular insert includes spring elements which extend from opposite internal walls thereof to resiliently bias the respective catch elements.

9. A magnetically releasable pin lock according to claim 5, wherein the front edges of said catch elements are formed with curved indentations aligned with said longitudinal axis to form gripper edges for a pin shank extending along said longitudinal axis.

10. A magnetically releasable pin lock according to claim 4, wherein a leg which comprises the actuation element of each catch element is bent down from the front edge of the respective element to extend down along opposite sides of said longitudinal axis.

11. A magnetically releasable pin lock comprising; a housing formed with an internal cavity and a pin access hole extending along a longitudinal axis into said cavity from outside said housing; a rigid catch element mounted within said cavity for limited pivotal movement about a pivot axis perpendicular to and displaced from said longitudinal axis, said catch element including a front edge which moves toward and away from said longitudinal axis as said catch element pivots about said pivot axis; said catch element being freely pivotal about said pivot axis, a spring element extending between a wall of said cavity and a location in said catch element between said pivot axis and said front edge and biasing said catch element front edge toward said longitudinal axis and said catch element being movable against said spring element in response to the application of a magnetic force.

12. A magnetically releasable pin lock according to claim 11, wherein a further catch element, similar to the said catch element, is arranged symmetrically therewith in said housing to pivot about a second pivot axis and to cooperate with the said catch element to grip a pin shank extending along said longitudinal axis between the front edges of said catch elements.

13. A magnetically releasable pin lock according to claim 12, wherein each catch element is of generally flat rectangular configuration.

14. A magnetically releasable pin lock according to claim 12, wherein shoulders are formed in said cavity to extend along said pivot axes and to support each of said catch elements along a rear edge thereof for free pivotal movement about said pivot axis.

15. A magnetically releasable pin lock according to claim 14, wherein a tubular insert is provided in said cavity and is shaped to form said shoulders.

16. A magnetically releasable pin lock according to claim 13, wherein the front edges of said catch elements are formed with curved indentations aligned with said longitudinal axis to form gripper edges for a pin shank extending along said longitudinal axis.

17. A magnetically releasable pin lock according to claim 12, wherein a leg which comprises the actuation element of each catch element is bent down from the front edge of the respective element to extend down along opposite sides of said longitudinal axis.

18. A magnetically releasable pin lock according to claim 15, wherein said spring elements are spring arms integral with and extending in cantilever fashion from said tubular element.

* * * * *

UNITED STATES PATENT AND TRADEMARK OFFICE

CERTIFICATE OF CORRECTION

PATENT NO. : 4,987,754

DATED : January 29, 1991

INVENTOR(S) : ARTHUR J. MINSAY ET AL.

It is certified that error appears in the above-identified patent and that said Letters Patent is hereby corrected as shown below:

COLUMN 1

Line 5, "Invention This" should read --Invention ¶ This--.
Line 27, "alarm. The" should read --alarm. ¶ The--.

COLUMN 3

Line 10, "nism are" should read --nism 14 are--.
Line 11, "wafer 14" should read --wafer 12--.

COLUMN 6

Line 63, "FIG. 7. It" should read --FIG. 7. ¶ It--.

COLUMN 7

Line 1, "comprising;" should read --comprising:--.

UNITED STATES PATENT AND TRADEMARK OFFICE

CERTIFICATE OF CORRECTION

PATENT NO. : 4,987,754

DATED : January 29, 1991

INVENTOR(S) : ARTHUR J. MINSAY ET AL.

It is certified that error appears in the above-identified patent and that said Letters Patent is hereby corrected as shown below:

COLUMN 8

Line 3, "comprising;" should read --comprising:--.

Signed and Sealed this

Eighth Day of December, 1992

*Attest:*

*Attesting Officer*

DOUGLAS B. COMER

*Acting Commissioner of Patents and Trademarks*